United States Patent [19]

Taft et al.

[11] 4,407,257

[45] Oct. 4, 1983

[54] METHOD AND APPARATUS FOR CONTROLLING AN IGNITION SYSTEM

[75] Inventors: Darwin O. Taft, Bainbridge; Howard E. Van Siclen, Jr., Sidney, both of N.Y.

[73] Assignee: The Bendix Corporation, Southfield, Mich.

[21] Appl. No.: 331,866

[22] Filed: Dec. 17, 1981

[51] Int. Cl.[3] ..... F02P 7/00

[52] U.S. Cl. ..... 123/612; 123/146.5 A; 310/70 A

[58] Field of Search ..... 123/146 JA, 599, 643, 123/612, 616, 617; 310/70 A, 155, 181; 324/174

[56] References Cited

U.S. PATENT DOCUMENTS 4,146,001 3/1979 McCarthy et al. ..... 310/70 A
4,259,938 4/1981 Johannsson ..... 310/70 A
4,267,803 8/1981 Foronato ..... 123/612
4,365,602 12/1982 Stillar et al. ..... 123/612

*Primary Examiner*—Raymond A. Nelli
*Assistant Examiner*—Doris Redman
*Attorney, Agent, or Firm*—Raymond J. Eifler

[57] ABSTRACT

This invention provides a method and apparatus for obtaining a uniform advance for an internal combustion engine requiring unequal firing angles between cylinders and is characterized by an electromagnetic pulse generator having a trigger wheel that includes a number of metal vanes greater than a number of cylinders in the internal combustion engine. Although the trigger wheel generates more trigger pulses for each operating cycle of the engine than there are spark plugs only the number of trigger pulses equal to the number of spark plugs are transmitted to one or more switching devices to allow the discharge of stored electrical energy through a respective spark plug in timed relation to the operating cycle of the engine.

16 Claims, 2 Drawing Figures

FIG. 1
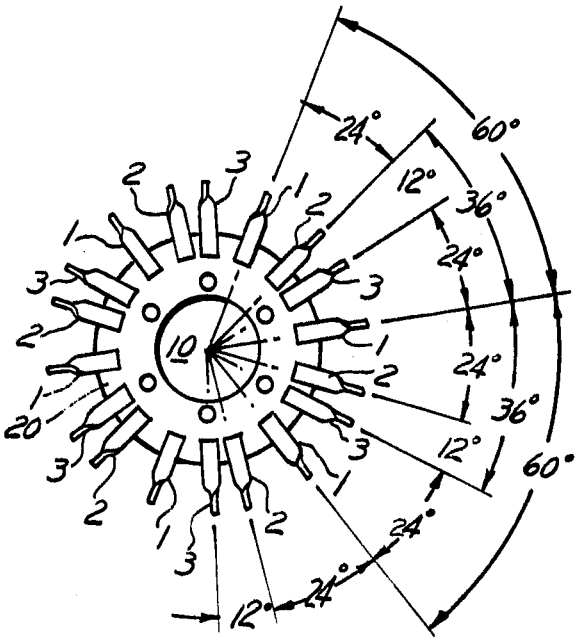
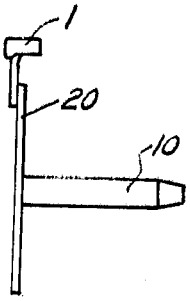
FIG. 2

METHOD AND APPARATUS FOR CONTROLLING AN IGNITION SYSTEM

This invention relates to an ignition system for an internal combustion engine and more particularly to a method of generating timing pulses and distributing them to a switch to discharge electrical energy through the spark plugs of the engine.

An ignition system for a multicylinder internal combustion engine generally includes: means for generating electrical energy; means for storing electrical energy, such as a capacitor or inductor; a plurality of spark plugs; and means for distributing and discharging the stored electrical energy to each spark plug in timed relation to the operating cycle of the engine. Examples of such an ignition system may be found in U.S. Pat. No. 4,269,152 entitled "Breakerless Pulse Distribution System and Opto-Electrical Distributor Therefore" issued May 26, 1981; and U.S. Pat. No. 3,952,715 entitled "Variable and Constant Timing for Breakerless Ignition" issued Apr. 27, 1976. In the foregoing ignition systems, an electromagnetic pulse generating apparatus is used to generate electrical pulses in timed relation to the operating cycle of the engine to trigger a properly timed discharge of stored electrical energy into each spark plug. An example of such an electro-magnetic pulse generator may be found in U.S. Pat. No. 3,252,024 entitled "Electrical Pulse Generating Means" issued May 17, 1966. Such a pulse generator generally comprises a magnetic circuit and a rotating trigger wheel having metal vanes that rotate through the magnetic circuit. Each time a vane passes through the magnetic field of the circuit it disturbs the field and generates an electrical trigger pulse in the circuit which is transmitted through a distributor to a switch to discharge electrical energy into a predetermined spark plug. Ignition systems of the type shown in the '152 patent may have its timing changed (advanced or retarded) as described in the '715 patent so long as the required trigger pulses to be generated for a particular engine are separated by an even number of degrees, i.e., every 30 degrees or every 40 degrees (called an even firing sequence, as the firing of each cylinder always occurs after the same number of degrees). In an even firing circuit, where the angle between each trigger vane is the same, the disturbance of the magnetic field is symmetrical and there is no difference between the angles of the actual firing sequence and the angles between the vanes on the trigger wheel. However, to advance the spark in this type of circuit four degrees for an engine that requires the firing of its spark plugs at unequal intervals such as 24°, 36°, 24°, 36°, etc., the effect of the advance on the circuit in '152 patent results in a firing sequence of 28°, 32°, 28°, 32°, etc. This small deviation from the firing sequence required by the engine and the actual firing sequence detrimently effects the operating efficiency of the engine. Attempts at moving the vanes of the trigger wheel to avoid this deviation does not work because the unsymmetrical disturbance of the magnetic field remains.

Accordingly, it is a problem obtaining maximum performance when a spark advance is required, from a multicylinder internal combustion engine having uneven firing of the cylinders when an electromagnetic trigger pulse generator is employed in the ignition circuit.

DISCLOSURE OF THE INVENTION

This invention provides a method and apparatus for obtaining a uniform advance for an internal combustion engine requiring unequal firing angles between cylinders.

The invention is an ignition system for an internal combustion engine characterized by an electromagnetic pulse generator having a wheel that includes a number of metal vanes greater than the number of cylinders in the internal combustion engine.

One advantage of the invention is that it improves the operating efficiency of an internal combustion engine requiring unequal firing angles when it is necessary to advance or retard the firing angle.

Another advantage is that the invention advances or retards each firing angle an equal number of degrees so that the firing intervals remain substantially unchanged.

Another advantage of this invention is that when a timing change is required of an engine ignition system because of a change in fuel, speed, load, temperature or some other engine parameter the change can be accomplished electronically without shutting down the engine.

BRIEF DESCRIPTION OF THE DRAWINGS

FIG. 1 illustrates the trigger wheel of an electromagnetic generator that incorporates the principles of the invention.

FIG. 2 is a side view of a trigger wheel that illustrates the configuration of a vane 1 and how the shaft 10 projects from the disk 20.

DETAILED DESCRIPTION OF THE INVENTION

FIG. 1 illustrates the trigger wheel of an electromagnetic generator that incorporates the principles of the invention. The trigger wheel shown may be used with the ignition system shown in U.S. Pat. No. 4,269,152 for a 12-cylinder engine that requires unequal firing. A shaft 10, for rotating the trigger wheel, is connected by some means (not shown) to the crank shaft of the internal combustion engine so that the trigger wheel will rotate in timed relation to the operating cycle of the engine. A disk 20 is mounted to the shaft 10 and mounted to the disk 20 are a first plurality of vanes 1, located 60 degrees from each other, a second plurality of vanes 2, each located 24 degrees after a respective vane 1 in the first plurality, and a third plurality of vanes 3 each located 12 degrees after a respective vane 2 in said second plurality. This arrangement results in a first angular displacement between vanes 1 and 2 of 24 degrees; a second angular displacement between vanes 2 and 3 of 12 degrees; and a third angular displacement between vanes 3 and 1 is of 24 degrees. In the preferred embodiment shown the first and third angular displacements are equal. When the trigger wheel is rotated through a magnetic field of a trigger coil, as explained in U.S. Pat. No. 3,252,024, 18 trigger pulses are generated by the vanes 1, 2 and 3 for each revolution. By blocking out the pulses generated by the third plurality of vanes 3, and distributing the remaining pulses the firing sequence of 24° and 36° is retained. Accordingly, this trigger wheel is designed for use with a 12-cylinder engine requiring unequal firing angles of 24° and 36° between cylinders.

To modify the trigger wheel for use with an engine having more or less than 12-cylinders and unequal firing angles different than 24° and 36° the trigger wheel would simply be modified by subtracting the difference between the two unequal firing angles and adding a vane after the vane that causes the first firing angle at a distance equal to the number of degrees equal to the difference between the firing angles. Preferably, the first and third angular displacements between vanes should be equal.

FIG. 2 is a side view of a trigger wheel that illustrates the configuration of a vane 1 and how the shaft 10 projects from the disk 20.

While a preferred embodiment of the invention has been disclosed, it will be apparent to those skilled in the art that changes may be made to the invention as set forth in the appended claims and, in some instances, certain features of the invention may be used to advantage without corresponding use of other features. For instance, the trigger wheel may be modified to have more or less than the vanes shown depending on the number of cylinders in an engine. Accordingly, it is intended that the illustrative and descriptive materials herein be used to illustrate the principles of the invention and not to limit the scope thereof.

Having described the invention what is claimed is:

1. A method of controlling an ignition system for an internal combustion engine, said ignition system of the type having means for generating electrical energy, means for storing electrical energy, a plurality of spark plugs, and means for distributing and discharging said stored electrical energy to each of said spark plugs in timed relation to the operating cycle of said engine, said distributing and discharging means including a plurality of switching devices equal to the number of spark plugs, each device operatively connected to a respective spark plug and an electromagnetic pulse generator for generating electric pulses in timed relation to the operating cycle of the engine, each pulse adapted to operate a respective switching device in timed relation to the operating cycle of the engine, the method comprising:

generating with said electromagnetic pulse generating means and for each operating cycle of the engine a number of trigger pulses greater than the number of spark plugs; and distributing only the number of trigger pulses equal to the number of spark plugs to a respective switching device for each operating cycle of the engine to permit discharge of said stored energy through each of said spark plugs in timed relation to the operating cycle of the engine.

2. The method as recited in claim 1 wherein the trigger pulses have a first, second and third angular displacement with respect to the operating cycle of the engine, with said first angular displacement is equal to said third angular displacement.

3. The method as recited in claim 2 wherein the trigger pulse at the end of the first and third angular displacements are the trigger pulses chosen to be distributed to said switching device to permit discharge of said stored energy through a spark plug.

4. The method as recited in claim 3 wherein the engine has twelve cylinders and wherein the first angular displacement is twenty-four degrees, the second angular displacement is twelve degrees and the third angular displacement is twenty four degrees.

5. The method recited in claim 1, 2, 3 or 4 wherein there are one and a half times as many trigger pulses generated for each operating cycle of the engine as there are spark plugs.

6. A method of controlling an ignition system for an internal combustion engine, said ignition system of the type having means for generating electrical energy, means for storing electrical energy, a plurality of spark plugs, and means for distributing and discharging said stored electrical energy to each of said spark plugs in timed relation to the operating cycle of said engine, said distributing and discharging means including a plurality of switching devices equal to the number of spark plugs, each device operatively connected to a respective spark plug and an electromagnetic pulse generator for generating electric pulses in timed relation to the operating cycle of the engine to operate said switching devices in timed relation to the operating cycle of the engine, the method comprising:

generating with said electromagnetic pulse generating means and for each operating cycle of the engine a sequence of trigger pulses having different angular displacements between some of said pulses; and distributing only the number of trigger pulses equal to said number of spark plugs to each of said switching devices to permit discharge of said stored energy through each of said spark plugs in timed relation to the operating cycle of the engine.

7. The method recited in claim 6 wherein the repeating sequence of trigger pulses have a first, second and third angular displacement with respect to the operating cycle of the engine, with said first angular displacement equal to said third angular displacement.

8. The method recited in claim 6 wherein for a twelve cylinder engine a repetitive sequence of pulses is generated having a first angular displacement of twenty-four degrees, a said second angular displacement of twelve degrees and a third angular displacement of twenty-four degrees.

9. The method recited in claim 8 wherein only the pulses generated at the first and third angular displacements are distributed.

10. In combination with an ignition system for a multicylinder internal combustion engine, said ignition system of the type having means for generating electrical energy, means for storing electrical energy, a plurality of spark plugs operatively connected to a respective engine cylinder, and means for distributing and discharging said stored electrical energy to each of said spark plugs in timed relation to the operating cycle of said engine, said distributing and discharging means including a switching device and an electromagnetic pulse generator for generating electric pulses in timed relation to the operating cycle of the engine that operate said switching device in timed relation to the operating cycle of the engine, said electromagnetic pulse generator including a magnetic circuit having a magnetic field and a trigger wheel having a plurality of metal vanes adapted to rotate through the magnetic field and generate a plurality of pulses in timed relation to the operating cycle of the engine, said trigger wheel having as many metal vanes as there are spark plugs, the improvement comprising:

a plurality of additional vanes added to said trigger wheel, said additional vanes generating pulses that do not operate said switching devices.

11. The ignition system as recited in claim 10 wherein for a twelve cylinder engine there are eighteen trigger wheel vanes that rotate through the magnetic field to generate 18 pulses.

12. The ignition system as recited in claim 10 wherein there are one and one-half as many times trigger wheel vanes as there are spark plugs.

13. The ignition system recited in claims 10, 11 or 12 wherein the vanes of said trigger wheel are repetitively x and y degrees apart and x is greater than y and where the additional vanes are located y minus x degrees after every other vane having x degrees spacing after a previous vane.

14. The ignition system as recited in claim 11 wherein the spacing between vanes of the trigger wheel in angular degrees is 24, 12, 24, 24, 12, 24, 24, 12, 24, 24, 12, 24, 24, 12, 24, 24, 12, 24.

15. The ignition system as recited in claim 14 wherein only the pulses generated after an angular displacement of 24 degrees operate said switching device.

16. The ignition system recited in claim 10 wherein there are at least two additional vanes, each added to said trigger wheel X degrees before a vane providing a pulse to said switching device, where X is equal to the smallest firing angle required by an engine.

* * * * *